US010493612B2

(12) United States Patent
Boswell et al.

(10) Patent No.: US 10,493,612 B2
(45) Date of Patent: Dec. 3, 2019

(54) SUPPORT FOR DEMOLITION DEVICES

(71) Applicants: Steven M. Boswell, Bend, OR (US); Jesse B. Boswell, Bend, OR (US)

(72) Inventors: Steven M. Boswell, Bend, OR (US); Jesse B. Boswell, Bend, OR (US)

( * ) Notice: Subject to any disclaimer, the term of this patent is extended or adjusted under 35 U.S.C. 154(b) by 0 days.

(21) Appl. No.: 16/199,346

(22) Filed: Nov. 26, 2018

(65) Prior Publication Data

US 2019/0168370 A1 Jun. 6, 2019

Related U.S. Application Data

(63) Continuation of application No. PCT/US2017/067693, filed on Dec. 20, 2017.

(60) Provisional application No. 62/438,918, filed on Dec. 23, 2016.

(51) Int. Cl.

| | |
|---|---|
| ***E04D 15/00*** | (2006.01) |
| ***B25D 17/28*** | (2006.01) |
| ***E04G 23/00*** | (2006.01) |

(52) U.S. Cl.

CPC ..... *B25D 17/28* (2013.01); *E04D 15/003* (2013.01); *E04G 23/006* (2013.01); *B25D 2250/005* (2013.01); *B25D 2250/051* (2013.01); *B25D 2250/115* (2013.01)

(58) Field of Classification Search

CPC ..... E04D 15/003; E04G 23/006

USPC ..... D15/32; 30/169, 170, 172; 81/45; 15/93.1; 299/36.1, 37.1, 37.2, 37.3, 37.4; 16/113.1, 405, 429, 327, 328, 345, 352, 16/353

See application file for complete search history.

(56) References Cited

U.S. PATENT DOCUMENTS

| | | | | |
|---|---|---|---|---|
| 843,818 | A * | 2/1907 | Hooghouse | |
| 1,059,054 | A * | 4/1913 | Lindelien | B25G 1/06 16/429 |
| 2,395,245 | A * | 2/1946 | Booharin | B25G 3/38 15/144.2 |
| 3,227,015 | A * | 1/1966 | Tremblay | B25B 13/06 16/429 |
| 5,462,127 | A | 10/1995 | Svensson | |

(Continued)

FOREIGN PATENT DOCUMENTS

| | | |
|---|---|---|
| WO | WO0027595 | 5/2000 |

OTHER PUBLICATIONS

International Patent Application No. PCT/US2017/67693 International Search Report and Written Opinion dated Feb. 26, 2018, 11 pages.

*Primary Examiner* — Sunil Singh

(74) *Attorney, Agent, or Firm* — Leber IP Law; Celia H. Leber

(57) ABSTRACT

A demolition device support has an elongated body that includes a base frame, a base frame support member, and an upper support member. The base frame is fixedly attached to the base frame support member, which is pivotably connected to the upper support member by a hinge. A handle extension member is mounted at the upper end of the body, and includes a mount for receiving handlebar. A collar is mounted at the lower end of the body, and is configured to receive a portion of the housing of a demolition device. The demolition device support is used to support a demolition device in an ergonomic and efficient position during use of the demolition device.

18 Claims, 7 Drawing Sheets

(56) References Cited

U.S. PATENT DOCUMENTS

| | | | | |
|---|---|---|---|---|
| 6,467,377 | B1 * | 10/2002 | Kersting | E04D 15/003 81/45 |
| 6,807,682 | B1 | 10/2004 | Shircliff | |
| 7,617,885 | B2 | 11/2009 | Howland | |
| 8,240,682 | B2 | 8/2012 | Kennard | |
| D816,124 | S * | 4/2018 | Wyser | D15/10 |
| 2016/0136799 | A1 | 5/2016 | Morissette et al. | |
| 2017/0138072 | A1 | 5/2017 | Tailly | |

* cited by examiner

SUPPORT FOR DEMOLITION DEVICES

RELATED APPLICATION

This application is a continuation of International Patent Application No. PCT/US2017/67693, filed Dec. 20, 2017, which claims priority from U.S. Provisional Application Ser. No. 62/438,918, filed on Dec. 23, 2016, the entire disclosure of which is incorporated herein by reference.

BACKGROUND

Demolition devices, such as demolition hammers (also known as jackhammers), hammer drills, and other reciprocating demolition equipment, allow tile and other flooring to be removed much more quickly than would be possible by hand. However, the weight and vibration of this equipment can make it very tiring to use, and it is generally necessary for the operator to use the equipment in a bent over position that is not ergonomic and may lead to injury. Thus, it is generally difficult for an operator to use the equipment constantly for an extended period of time, and such use may pose safety concerns.

In an effort to address these problems, wheeled trolleys have been developed to support jackhammers, e.g., as disclosed in U.S. Pat. No. 8,240,682, and commercially available from companies such as Makinex Construction Products.

While such devices address the problem of supporting the weight of the demolition equipment, many users will still be in a non-ergonomic position, and the trolley can be difficult or impossible to use in close quarters, such as the corner of a room.

SUMMARY

The present disclosure features supports for demolition devices that allow a user to work in an ergonomic position and efficiently apply force to the demolition device. The supported demolition device can be used in a wide variety of areas, including difficult to reach areas such as room corners, and for a wide variety of tasks, including tile removal, drilling, ice removal, flooring removal, concrete removal, and architectural design skim coats, to mention only a few examples. The demolition device supports disclosed herein also position the user away from the immediate area of dust and flying debris adjacent the substrate that is being worked on.

In one aspect, the invention features a demolition device support that includes (a) an elongated rigid body comprising a base frame configured to support a demolition device, a base frame support member, and an upper support member; (b) an attachment device, disposed at a distal end of the rigid body, configured to secure the demolition device to the base frame; and (c) a handlebar, extending from the opposite end of the body, configured to allow a user to maneuver the body; wherein the base frame is disposed at an angle with respect to the base frame support member.

Some implementations include one or more of the following features.

The angle between the base frame and base frame support member may be fixed and may be, for example, from about 35 to 55 degrees.

The upper support member may be pivotably mounted on the base frame support member by a hinge. The hinge may be configured to allow an angle between the upper support member and the base frame support member to be adjusted.

The hinge may be configured so that the angle can be selected between at least two discrete predetermined positions. The hinge may comprise tubular end portions of the upper support member and the base frame support member that are disposed side-by-side, a bolt about which the end portions pivot, and a pair of angle brackets, disposed on opposite sides of the end portions. The angle brackets may include openings that allow the hinge to be bolted in place in predetermined positions.

The device may further comprise a handle extension member disposed between the upper support member and handlebar and slidably mounted on the upper support member. The handle extension member may include a pair of side slots, and be mounted on the upper support member by adjustable fasteners that extend through the slots and into the upper support member. Each slot may be from about 3 to 6 inches long.

The device may further include a knee brace extending from a surface of the rigid body opposite a support surface of the base frame, the knee brace being configured to allow a user to push against the elongated body with the user's leg.

In another aspect, the disclosure features a demolition device support that includes: (a) an elongated rigid body comprising a base frame having a support surface configured to support a demolition device, a base frame support member, and an upper support member; (b) a knee brace extending from a surface of the rigid body opposite the support surface, the knee brace being configured to allow a user to push against the body with the user's leg; (c) an attachment device, disposed at a distal end of the rigid body, configured to secure the demolition device to the base frame; and (d) a handlebar, extending from the opposite end of the body, configured to allow a user to maneuver the body.

Some implementations include one or more of the following features. The device support does not include wheels. The device support is not free-standing. The device has a width, exclusive of the handlebar, of less than 8 inches, preferably less than 6 inches. The knee brace includes a cushioning pad. The knee brace is formed by side skirt members of the base frame. The knee brace is at least 6 inches long.

The disclosure also features methods of using the demolition device supports disclosed herein.

For example, in one aspect the disclosure features a method comprising:

- providing a demolition device support comprising:
  - an elongated rigid body comprising a base frame, a base frame support member, and an upper support member;
  - an attachment device, disposed at a distal end of the rigid body; and
  - a handlebar, extending from the opposite end of the body, configured to allow a user to maneuver the body;
  - wherein the base frame is disposed at an angle with respect to the base frame support member; and
- attaching a demolition device to the demolition device support using the attachment device, in a position such that a portion of the demolition device is supported by the base frame.

In some implementations, methods may include one or more of the following features.

The upper support member may be pivotably mounted on the base frame support member by a hinge, and the method may further comprise a user adjusting an angle between the upper support member and the base frame support member by pivoting the upper support member about the hinge. The method may further comprise the user fixing the angle between the upper support member and base frame support member in a predetermined position. The demolition device support may further comprise a knee brace, and the method may further comprise exerting a force with a user's leg against the knee brace during use of the demolition device. The method may also further comprise extending a handle extension member to raise the height of the handlebar relative to the base frame.

DETAILED DESCRIPTION

Figure 1:
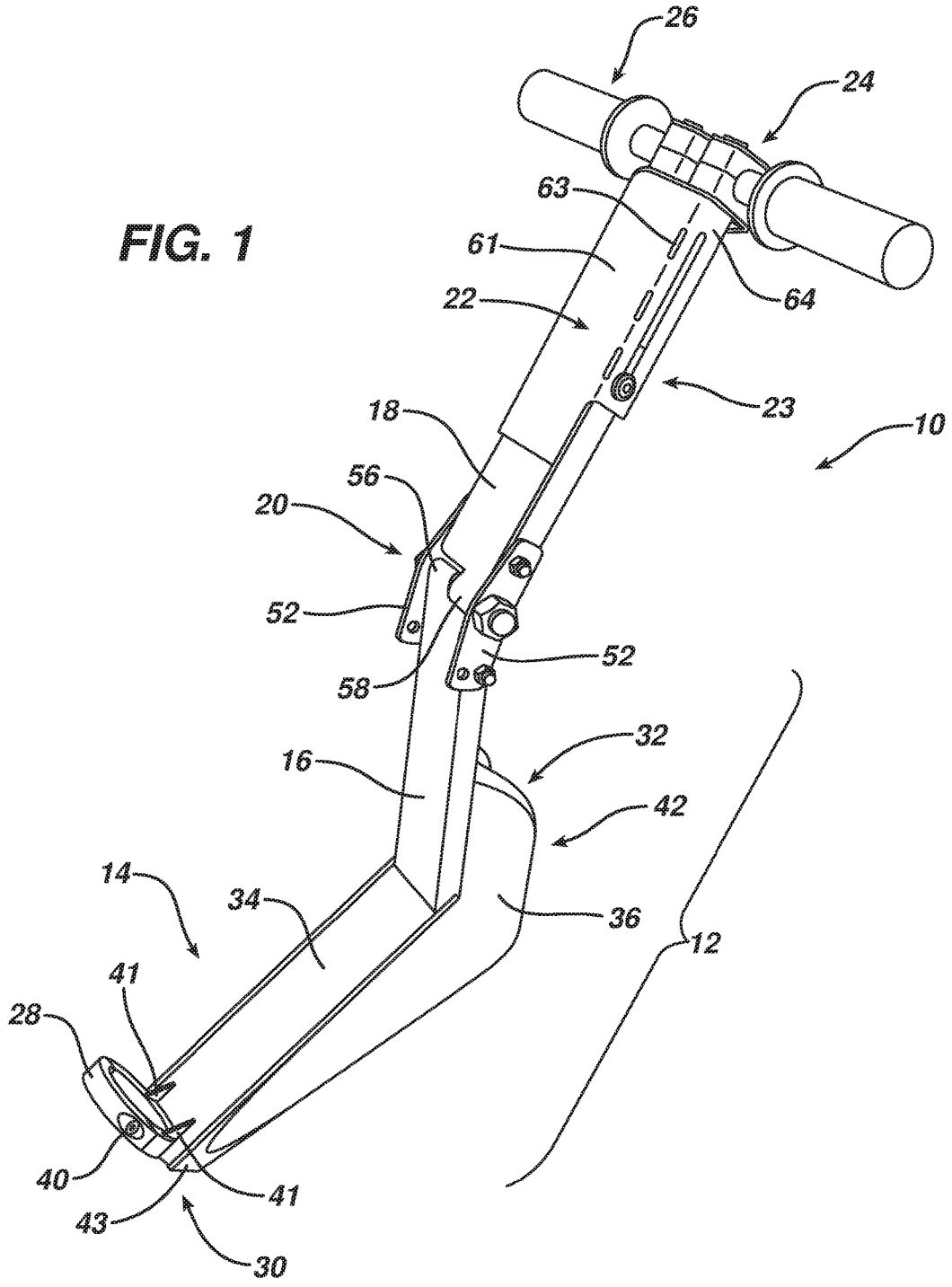
FIG. 1 is a perspective view of a demolition device support according to one implementation.

Referring to FIG. 1, a demolition device support 10 has an elongated body 12 that includes a base frame 14, a base frame support member 16, and an upper support member 18. The base frame 14 is fixedly attached to the base frame support member 16, which is pivotably connected to upper support member 18 by a hinge 20.

Figure 2:
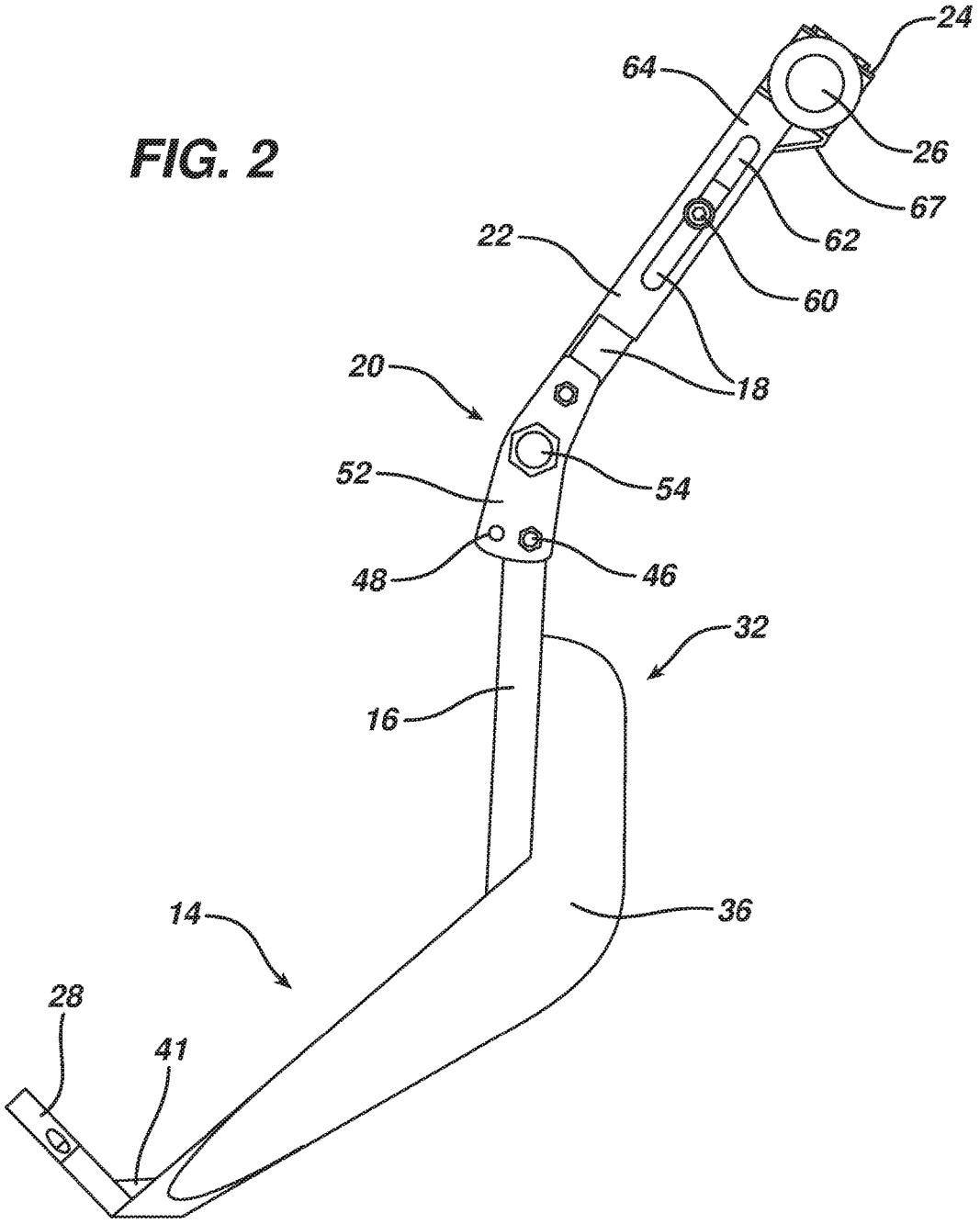
FIG. 2 is a side view of the demolition device support of FIG. 1.
Figure 3:
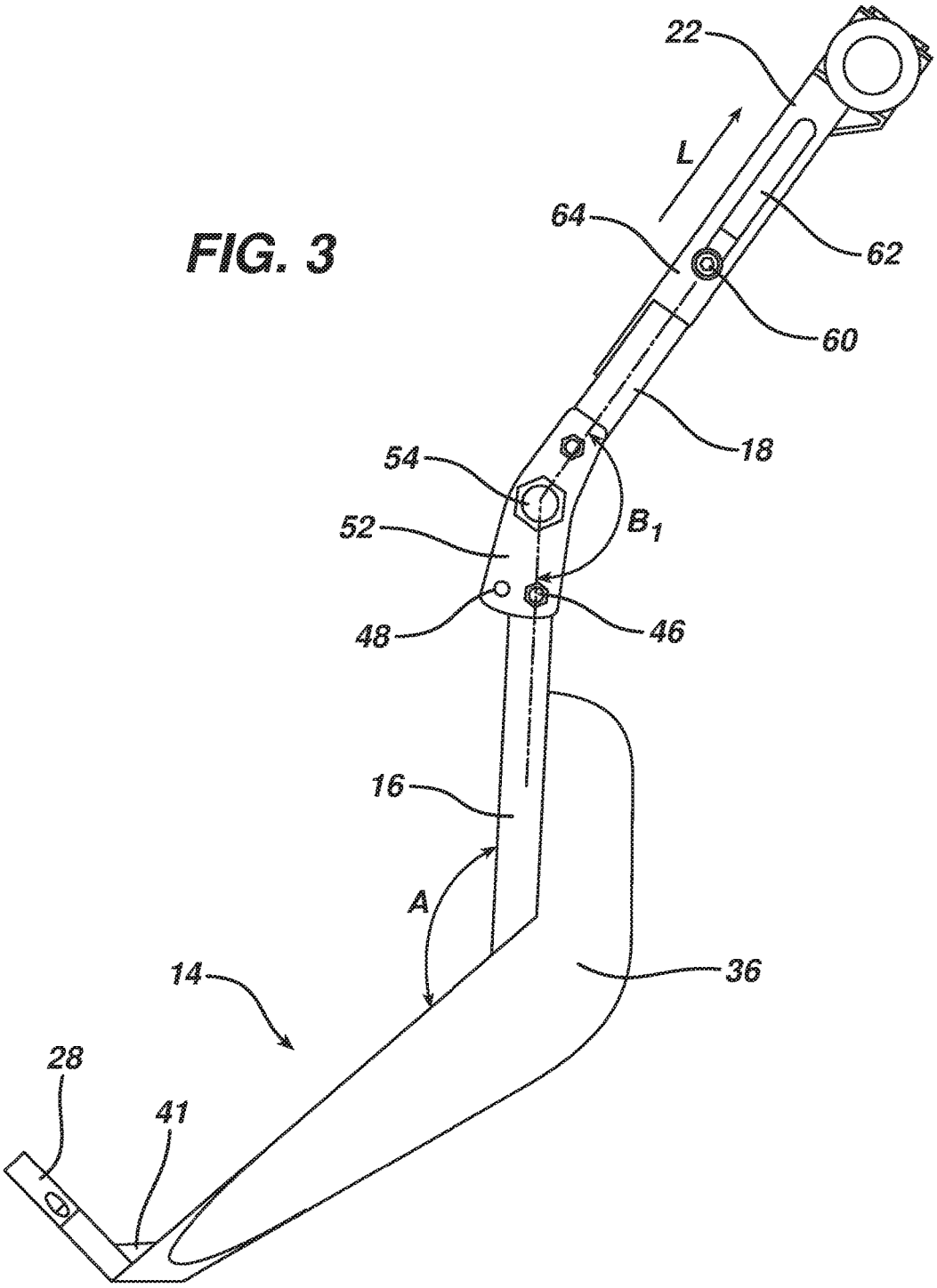
FIG. 3 is similar to FIG. 2, but shows the handle extension member of the support in an extended position.

As shown in FIG. 3, and as will be discussed in detail below, the body 12 includes two angles, angle A between the base frame 14 and the base frame support member 16, and angle B between the base frame support member and upper support member. In the preferred implementation shown in FIGS. 1-5, angle A is fixed and angle B is adjustable. Angles A and B are preferably selected so that when the demolition device support 10 is in use the flat, knee-engaging surface of knee brace 32 will generally maintain an angle to the substrate (e.g., floor) of about 80 to 110 degrees. This angle allows the user to apply optimum forward movement leverage to the demolition device, considering the optimum angle of the demolition device tool (e.g., a chisel bit) to the substrate surface. Angles A and B, in combination with the length from the bottom of upper support member to the handlebar, allow the user to work in an ergonomic position without bending or hunching over.

A handle extension member 22 is mounted at the upper end 23 of the body 12, and includes a mount 24 for receiving handlebar 26.

Figure 5:
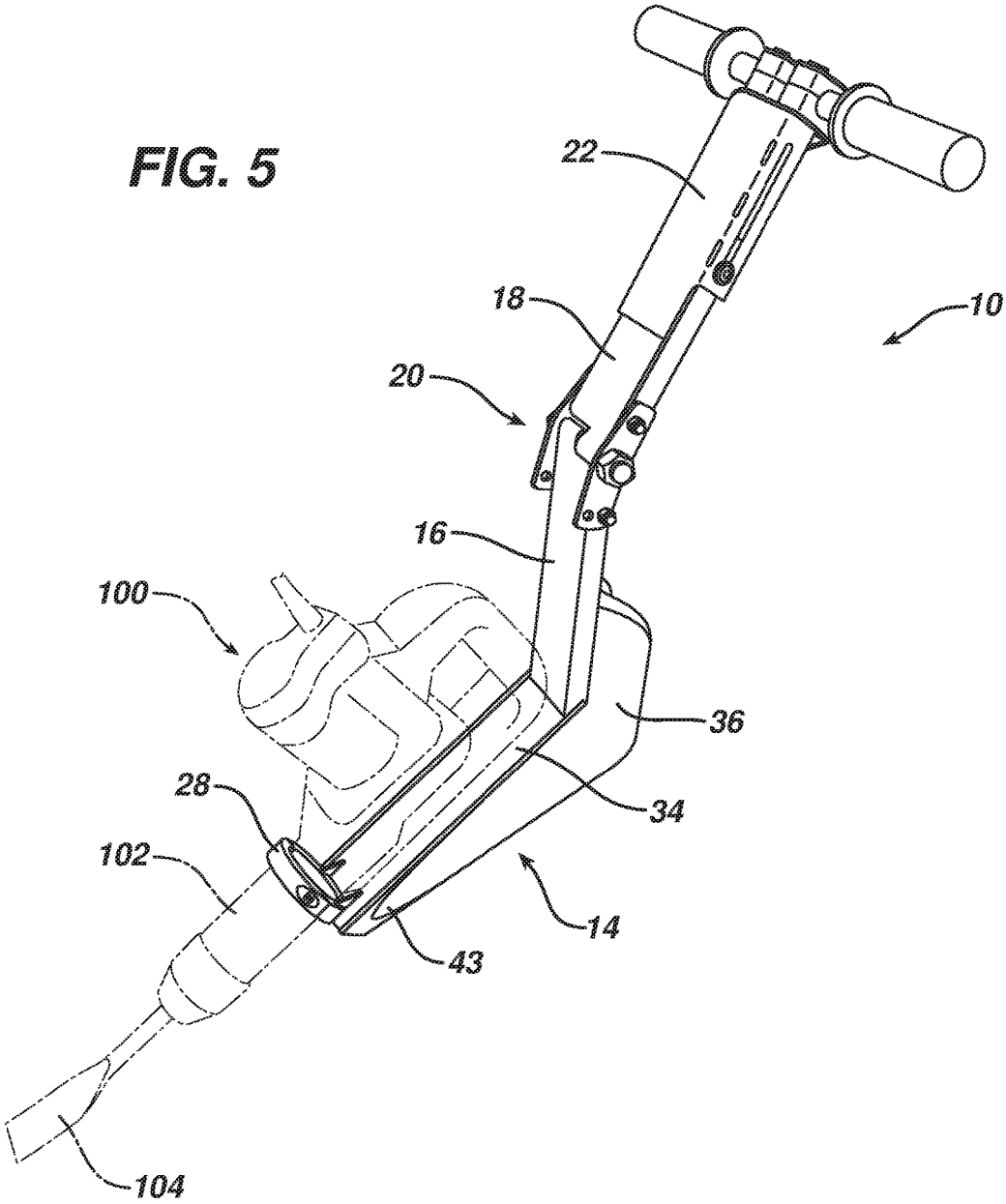
FIG. 5 is similar to FIG. 1, but shows a demolition hammer in phantom lines, mounted on the demolition device support.

A collar 28 is mounted at the lower end 30 of the body 12, and is configured to receive a cylindrical portion of the housing 102 of a demolition device 100, as shown in FIG. 5. When the demolition device 100 is positioned as shown in FIG. 5, the weight of the device is supported by the base frame 14.

The demolition device support 10 also includes a knee brace 32, extending towards the user from the back side of the base frame support member. Knee brace 32 is preferably padded, and is contoured to receive the knee of a user, to allow the user to apply force to the demolition device through the user's legs rather than solely the user's upper body.

In some implementations, the parts of the support 10 are made of 12-13 gauge (⅛ inch) steel, and thus the support 10 as a whole has a weight of at least 15 pounds, e.g., from about 15 to 25 pounds. The inventor has found that this relatively heavy weight is advantageous during use, as it dampens vibration and helps hold the demolition device against the substrate during the hammering action of the demolition device. Preferably the base 34 of base frame 14, the base frame support member 16, and the upper support member 18 are formed of steel rectangular cross-section hollow tubing, e.g., 1×3 inch mild steel rectangular tubing.

The various parts and features of the demolition device support will now be discussed in detail.

Base Frame

Figure 1A:
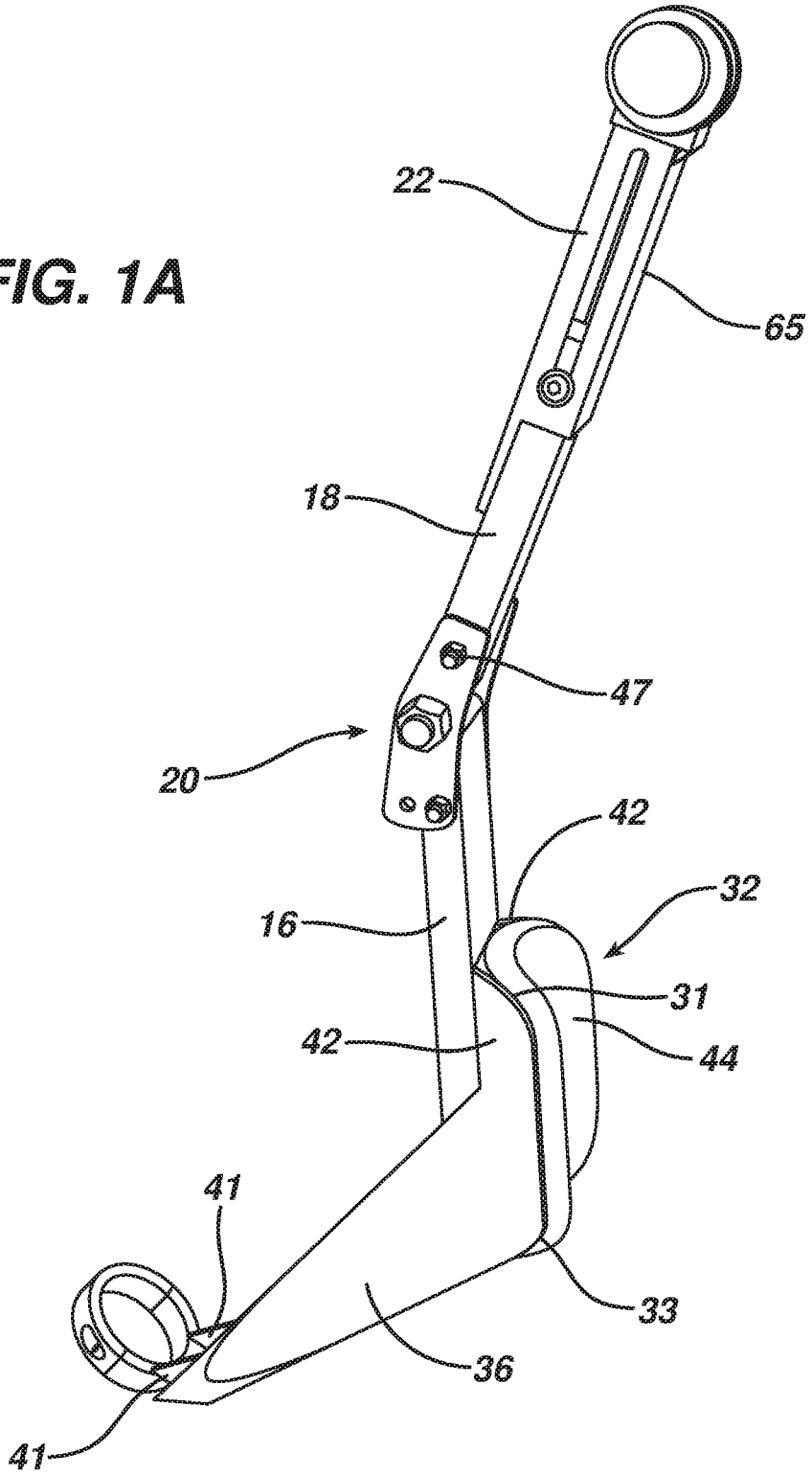
FIG. 1A is a perspective view of the demolition device support of FIG. 1, taken from a different direction.
Figure 1B:
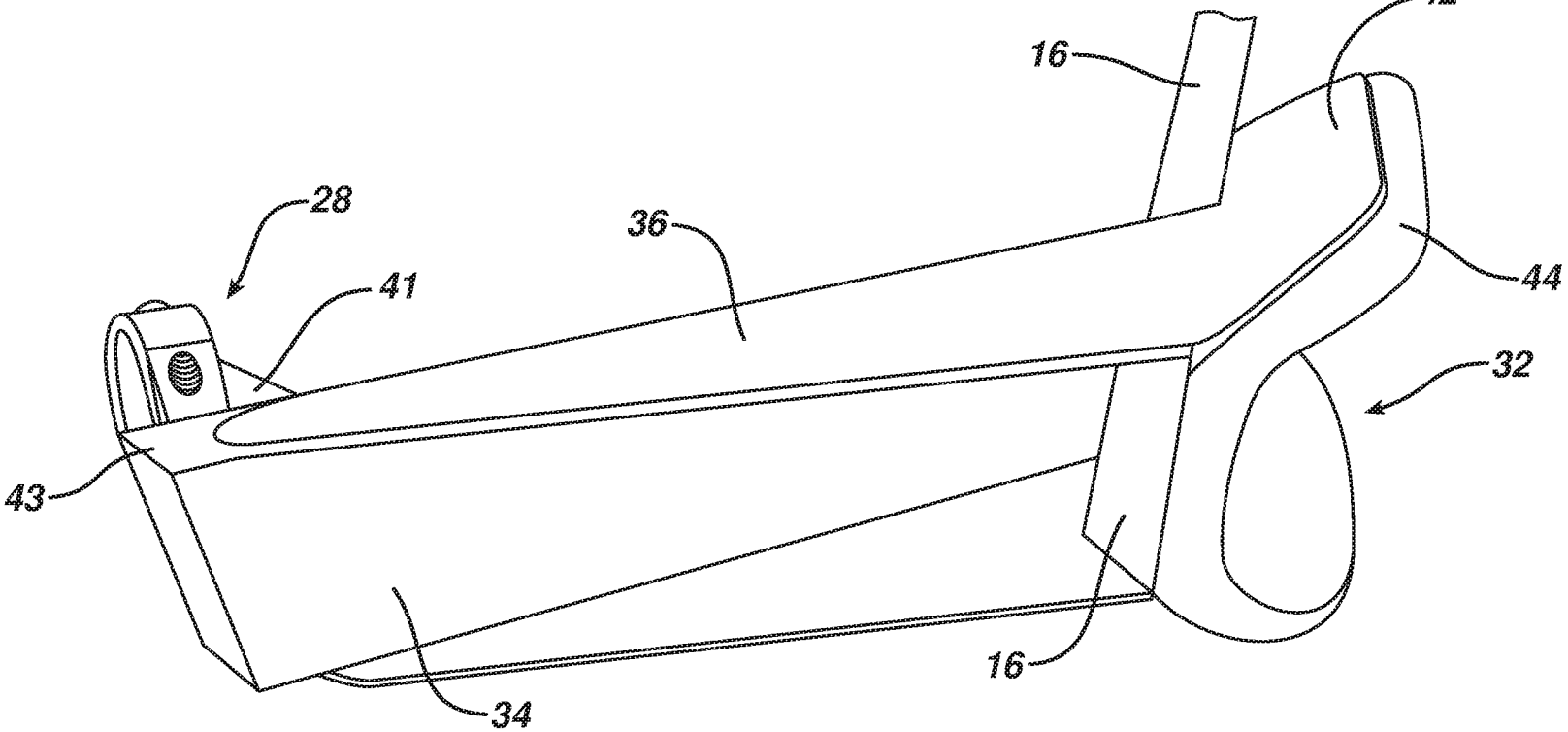
FIG. 1B is a perspective view of the demolition device support of FIG. 1 as seen from below.

Referring again to FIG. 1, the base frame 14 includes the collar 28, a base 34 on which the collar is mounted, e.g., by welding, and a pair of side skirts 36 which are welded to opposite side walls of the base 34. The base 34 is a tubular member with a rectangular cross-section, as discussed above. As can be seen in FIG. 1B, the base 34 is welded to the upper edges of the side skirts, such that there is an open area between the lower portions of the side skirts.

The collar includes gussets 41 on either side of its circumference to mount the collar securely on the base 34 and resist the vibrational forces exerted by the demolition device in use.

The collar is positioned to receive the cylindrical portion of the demolition device that typically includes a removable handle, and is configured to allow a demolition device to be easily installed on and removed from the base 34 using a pair of bolts 40 disposed on opposite sides of the collar as is well known. The collar is sized to accommodate different makes, models and sizes (small to medium) of demolition hammers. The collar is preferably positioned at the distal end of the base 34, so that the nose 43 of the base frame is generally positioned below and adjacent the transition between the cylindrical portion of the demolition device 100 and the main body of the demolition device (FIG. 5).

The length of the base 34 can be selected by the manufacturer to accommodate different sized demolition devices. For example, the base 34 can be made longer than shown in FIG. 1, without needing to change the dimensions of the side skirts 36, to accommodate a larger demolition device with the collar and nose still being correctly positioned on the demolition device.

The nose 43 of the base frame is closed, and is preferably angled to cause minimal catch of material being demolished. The nose angle can be, for example, from about 20 to 45 degrees, e.g., 25 to 35 degrees.

The side skirts 36 act as gussets to support the fixed, angulated mounting of the base frame support member 16 on the base 34, discussed below. Each of the side skirts 36 also includes a flared upper portion 42. The opposed flared upper portions 42, with the back surface of the base support member 16, provide the contoured metal base of knee brace 32, as best seen in FIG. 1A. A pad 44, e.g., formed of a thermoplastic elastomer, closed cell foam or other resilient cushioning material, is preferably applied to this hard metal base for user comfort when using the knee brace 32. The pad 44 also tends to reduce user fatigue. The knee brace 32 gives the user added leverage and allows the user to utilize the strength of his or her lower body. Preferably, the knee brace is at least 6 inches long, measured in the center of the brace parallel to the length of the base support member 16, e.g., from 6 to 10 inches long, or about 7 to 9 inches long, to allow the user to maneuver the demolition device without slipping out of the knee brace. In some implementations, the angled sides of the knee brace are disposed at an angle of from about 110 to 150, e.g., about 120 to 140 degrees with respect to the flat central portion of the brace (measured on the surface of the pad 44.) The flared upper portions 42 have curved edges 31, 33 (FIG. 1A) for safety.

The lower edges of the side skirts define a plane that is at an angle of about 110 to 130 degrees with respect to the longitudinal axis of the base frame support member. This allows the side skirts to support the weight of the demolition hammer and demolition hammer support 10, when the user needs to rest, without the user having to lower the combined weight very far, or tip it back very far to resume work.

The base frame does not include wheels, and thus has an advantageously narrow width for getting into tight areas, for example, less than 8 inches and in some cases less than 6 inches. The absence of wheels also makes the support 10 easy to maneuver over a wide range of positions relative to the substrate and to vertical objects that might be encountered during use (walls, posts and the like.) Because the base frame does not include wheels, the support 10 is not self-supporting (i.e., it does not stand up on its own) when it is being used.

Because the base frame is made of hollow steel tubing, a port (not shown) can be included, e.g., in the top surface of base frame support member 16, to accommodate a vacuum coupler to assist in removal of dangerous dust. This vacuum coupler is shown in U.S. Provisional Application 62/438,918, the complete disclosure of which is incorporated by reference herein.

Base Frame/Base Frame Support Member Interface

The base frame support member 16 is fixedly joined to the base 34 of the base frame 14, e.g., by welding, at a predetermined angle that is not adjustable. This angle is selected to support the demolition device at an angle to the substrate (e.g., floor or other work surface) that maximizes the advantage of the tool 104 (chisel, drill bit, etc.) of the demolition device, as shown in FIG. 5. The inventor has found that the preferred angle between the base frame and base frame support member does not vary based on the user's height or body type, but instead is relatively independent of these factors. Thus, these parts can be fixed relative to each other, allowing the use of side skirts 36 and welding to provide a strong, robust joint between the base 34 and base frame support member 16. It is important that this joint be strong due to the high forces exerted on it during use of the demolition device.

The angle between the top surfaces of base frame support member 16 and base 34, shown as angle A in FIG. 3, is a set value determined to optimize the user's leverage of knee/shin to the base frame 14, transmitted through the knee brace 32 and base frame support member 16. The angle is selected to allow the user to ergonomically accomplish the task at hand, maintaining a position that will minimize lumbar, thoracic spine, shoulder, neck, and overall muscle fatigue.

If this angle A is too small the knee brace 32 will be too close to the floor, and thus too low on the leg to maintain optimum forward leverage force, also known as the user's power zone.

If the angle A is too large the user will tend to experience the knee brace 32 as being too high off the ground during use, thus making it hard to achieve optimal use of forward leverage force.

Angle A is preferably from about 110 to 150 degrees, more preferably from about 120 to 140 degrees. In some implementations, the angle is 130+/−5 degrees.

Base Frame Support Member/Upper Support Member Interface

Figure 4:
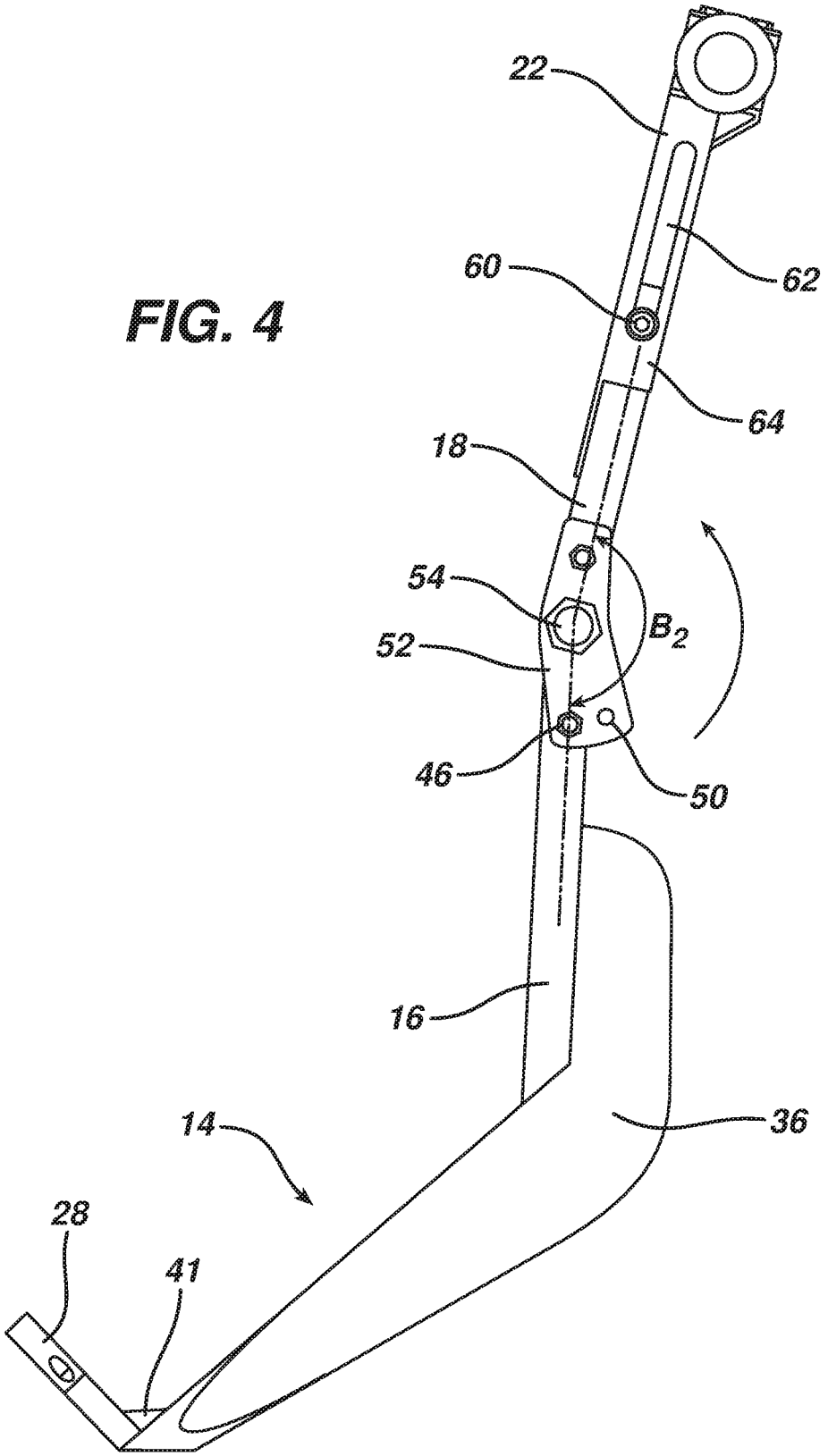
FIG. 4 is similar to FIGS. 2 and 3, but shows the upper support member disposed at a different angle with respect to the base frame support member.

The base frame support member 16 is joined to the upper support member 18 by a hinge 20. As best seen in FIGS. 3 and 4, hinge 20 allows the angle between these two members to be fixed in either of two predetermined positions: a first angle B1 (FIG. 3) for shorter users, and a second angle B2 (FIG. 4) for taller users. Adjusting this angle allows a preferred angle of the tool 104 to the substrate to be maintained without compromising ergonomics for users of different heights and body types.

The desired angle setting is maintained by inserting a bolt 46 through one or the other of two openings 48, 50 in each of a pair of angle brackets 52 and through a chase in the base frame support member 16, disposed between the angle brackets. A bolt 47 extends through both angle brackets and a chase member (not shown) that extends through the upper support member 18, securing the top part of the hinge.

A hinge bolt 54 extends through the angle brackets 52 and through bores (not shown) in mating tubular hinge portions 56, 58 of the base frame support member 16 and upper support member 18, respectively, to form hinge 20. This hinge construction allows easy disassembly of the body 12 and provides a strong, robust pivoting connection. The hinge bolt 54 may be, for example, a ¾ inch (or metric equivalent) bolt to provide the hinge 20 with good strength. The angle brackets 52 are constructed to provide a rigid, solid joint between the two elongated members 16 and 18, and may be formed, e.g., of 12-13 gauge mild steel.

Preferably, angle B can range from about 130 to 180 degrees. In the implementation shown, in which there are two fixed positions for this angle, B1 and B2, angle B1 is from about 130 to 160, e.g., 140 to 150 degrees, while angle B2 is from about 150 to 180, e.g., 160 to 170 degrees. Angle B2 is greater than angle B1, for example by about 15 to 25 percent, e.g., by about 10 to 30 degrees, and in some implementations about 15 to 25 degrees.

Handle Extension Member/Upper Support Member Mounting

The handle extension member 22 includes a front face plate 61 and a pair of side walls 64 extending from opposite edges of the face plate 61 to cover side surfaces of the upper support member 18. A pair of slots 62 are provided in the side walls 64. The face plate and side walls of the handle extension member may be formed from a single sheet of metal by bending, e.g., utilizing perforations 63 (FIG. 1.) A rear plate 65 (FIG. 1A) is welded to the edges of side walls 64 to provide a rectangular tubular member that is configured to slide over the rectangular tubular upper support member 18.

The handle extension member 22 is slidably mounted on the upper support member 18, to allow extension of the length between the handlebar 26 and the hinge 20, as shown in FIGS. 2 and 3 (see arrow L in FIG. 3). Sliding movement is accomplished by adjustment of a pair of bolts 60, each of which is mounted in a threaded bore (not shown), e.g., a weld nut, in upper support member 18. When the bolts 60 are loosened the handle extension member 22 can slide over the upper support member 18 in direction L, guided by the sliding engagement of bolts 60 in slots 62. The bolts 60 are tightened to securely hold the handle extension member 22 in a desired position.

It is generally preferred that each slot 62 have a length of from about 3 to 6 inches, e.g., 3.5 to 4.5 inches. Preferably the slot is dimensioned so that the distance from the handlebar 26 to the hinge 20 can be increased by up to 3 inches, in some implementations as much as 6 inches, to accommodate taller users. This feature helps the user to maintain an ergonomic position with good posture, and avoid having to hunch over while working.

Handlebar Mounts

The handlebar 26 is removably mounted at the upper end of the handle extension member 22 to an end cap 67 (FIG. 2) of the handle extension member, e.g., by mount 24, which may comprise two, two-piece hose mounts as shown. The end cap 67 is configured to securely support the bases of the hose mounts. The hose mounts allow the handlebar to be removed for shipment and storage, and to be changed out for a different style of handlebar if desired. In some preferred implementations the handlebar is relatively short (e.g., less than 20 inches in length, in some cases 15 to 17 inches) in order to allow use of the support 10 in tight areas. The handle grips are preferably of a resilient, cushioning material to minimize user fatigue.

Shipping/Assembly/Adjustment

With the exception of the base frame and base frame support member, all other components of the support 10 can be disassembled for cost-effective shipping. In some cases, the hinge 20 will be assembled and the base frame support member and upper support member simply folded together for compact shipping.

To assemble the device for use, the user bolts the various pieces together into the configuration shown in FIG. 1. The rectangular tubular members preferably include tubular chases extending through the hollow interior of the member from bolt hole to bolt hole, to make it easy to thread the bolts (e.g., bolts 46 and 47) through the tubular members.

Once the device is assembled, the user can adjust the angle of the base frame support member to the upper support member, and the extension of the handle extension member, as discussed above.

A demolition device is installed in the support 10 by removing the top piece of the collar clamp, removing the factory installed handle from the demolition device, if one is included, placing the demolition device on the base frame (generally upside down), aligning the area where the factory installed handle was removed with the collar clamp, and replacing the top piece of the collar clamp to secure the demolition device in place.

Depending on the task, the support can be held with the knee brace facing the user, e.g., for flooring removal, or with the knee brace facing away from the user, e.g., for drilling concrete.

Other Embodiments

A number of embodiments have been described. Nevertheless, it will be understood that various modifications may be made without departing from the spirit and scope of the disclosure.

For example, different types of handlebars may be used, such as ergonomic handlebars that have ends that bend back towards the user.

Moreover, the angle between the base frame support member and upper support member could be adjustable between more than two positions, if further adjustability is desired. It is preferred that adjustability be between discrete locked positions, rather than continuous (e.g., with a curved slot) for strength and resistance to movement due to vibration.

If height adjustment is not required, for example if the demolition device support were sold in various sizes, the handle extension member could be omitted and the handle mount could be disposed at an upper end of the upper support member.

Accordingly, other embodiments are within the scope of the following claims.

What is claimed is:

1. A demolition device support comprising:

an elongated rigid body having a distal end and a proximal end, the elongated rigid body comprising a base frame configured to support a demolition device, a base frame support member, and an upper support member, the upper support member being pivotably mounted on the base frame support member by a hinge, the hinge comprising end portions of the upper support member and the base frame support member that are disposed side-by-side, a bolt about which the end portions pivot, and a pair of angle brackets, disposed on opposite sides of the end portions;

an attachment device, disposed at the distal end of the elongated rigid body, configured to secure the demolition device to the base frame; and a handlebar, extending from the proximal end of the elongated rigid body, configured to allow a user to maneuver the elongated rigid body;

wherein the base frame is disposed at an angle with respect to the base frame support member, the base frame does not include wheels, and the base frame is configured to extend below the demolition device and support the demolition device during use.

2. The demolition device support of claim 1, wherein the angle between the base frame and base frame support member is fixed when the demolition device support is in use and is from about 35 to 55 degrees.

3. The demolition device support of claim 1, wherein the hinge is configured to allow an angle between the upper support member and the base frame support member to be adjusted.

4. The demolition device support of claim 3, wherein the hinge is configured so that the angle between the upper support member and the base frame support member can be selected between at least two discrete fixed positions.

5. The demolition device support of claim 1, wherein the angle brackets include openings that allow the hinge to be bolted in place in predetermined positions.

6. The demolition device support of claim 1, further comprising a handle extension member disposed between the upper support member and handlebar and slidably mounted on the upper support member.

7. The demolition device support of claim 6, wherein the handle extension member includes a pair of side slots, and is mounted on the upper support member by adjustable fasteners that extend through the slots and into the upper support member.

8. The demolition device support of claim 7, wherein each side slot is from about 3 to 6 inches long.

9. The demolition device support of claim 1, further comprising a knee brace extending from a surface of the elongated rigid body opposite a support surface of the base frame, the knee brace being configured to allow a user to push against the elongated rigid body with a leg of the user.

10. A demolition device support comprising:

an elongated rigid body having a distal end and a proximal end, the elongated rigid body comprising a base frame having a support surface configured to be positioned below a demolition device during use to support the demolition device, a base frame support member that extends upwardly from the base frame during use, and an upper support member;

a knee brace extending from a surface of the elongated rigid body opposite the support surface, the knee brace being configured to allow a user to push against the elongated rigid body with the user's leg;

an attachment device, disposed at the distal end of the elongated rigid body, configured to secure the demolition device to the base frame; and a handlebar, extending from the proximal end of the elongated rigid body, configured to allow a user to maneuver the elongated rigid body;

wherein the base frame does not include wheels and thus the demolition device support is not self-supporting during use.

11. The demolition device support of claim 10 wherein the knee brace includes a cushioning pad.

12. The demolition device support of claim 10 wherein the knee brace is formed by side skirt members of the base frame.

13. A method comprising:

providing a demolition device support comprising:

an elongated rigid body having a distal end and a proximal end, the elongated rigid body comprising a base frame, a base frame support member, and an upper support member, the upper support member being pivotably mounted on the base frame support member by a hinge;

a knee brace extending from a surface of the elongated rigid body opposite a support surface of the base frame, the knee brace being configured to allow a user to push against the elongated rigid body with a leg of the user;

an attachment device, disposed at the distal end of the elongated rigid body; and a handlebar, extending from the proximal end of the elongated rigid body, configured to allow a user to maneuver the elongated rigid body;

wherein the base frame is disposed at an angle with respect to the base frame support member, the base frame does not include wheels, and the base frame is configured to extend below the demolition device and support the demolition device during use; and attaching a demolition device to the demolition device support using the attachment device, in a position such that a portion of the demolition device is supported by the base frame.

14. The method of claim 13, wherein the method further comprises adjusting an angle between the upper support member and the base frame support member by pivoting the upper support member about the hinge.

15. The method of claim 14, further comprising fixing the angle between the upper support member and base frame support member in a predetermined position.

16. The method of claim 13, wherein the method further comprises exerting a force against the knee brace during use of the demolition device.

17. The method of claim 13, further comprising extending a handle extension member to raise a height of the handlebar relative to the base frame.

18. The method of claim 13, further comprising lifting the base frame up to utilize the demolition device, and lowering the base frame to rest on the ground when the demolition device is not in use.

* * * * *